US006272704B1

(12) United States Patent
Cutler

(10) Patent No.: US 6,272,704 B1
(45) Date of Patent: Aug. 14, 2001

(54) PORTABLE DIAPER CHANGING BOARD

(76) Inventor: Lori A. Cutler, 1211 N. Grimesland Bridge Rd., Washington, NC (US) 27889

( * ) Notice: Subject to any disclaimer, the term of this patent is extended or adjusted under 35 U.S.C. 154(b) by 0 days.

(21) Appl. No.: 09/488,989

(22) Filed: Jan. 21, 2000

(51) Int. Cl.[7] ..... A47G 9/06

(52) U.S. Cl. ..... 5/655; 5/420; 5/722; 5/721; 5/657

(58) Field of Search ..... 5/655, 657, 722, 5/417, 420, 731; 190/2, 124

(56) References Cited

U.S. PATENT DOCUMENTS

D. 367,771 * 3/1996 Julian ..... D6/333
2,528,768 * 11/1950 Marsh ..... 5/657
3,143,748 * 8/1964 Manning ..... 5/657
5,265,292 * 11/1993 Underell ..... 5/419

* cited by examiner

*Primary Examiner*—Lynne H. Browne
*Assistant Examiner*—Fredrick Conley

(57) ABSTRACT

A portable diaper changing board for changing a child's diaper on a comfortable and safe surface. The portable diaper changing board includes four support members two of which are end members and two of which are intermediate member which are hingedly attached end-to-end to one another and to the end members with each of the support members having a concave to side and a flat bottom side; and also includes a plurality of fastening members for securing the support members in a folded position; and further includes a restraining member being removably attachable to the top side of one of the intermediate members for restraining a child thereon; and also includes a handle member securely attached to one of the ends of one of the intermediate members.

14 Claims, 2 Drawing Sheets

PORTABLE DIAPER CHANGING BOARD

BACKGROUND OF THE INVENTION

1. Field of the Invention

The present invention relates to a portable baby changing board and more particularly pertains to a new portable diaper changing board for changing a child's diaper on a comfortable and safe surface.

2. Description of the Prior Art

The use of portable baby changing board is known in the prior art. More specifically, portable baby changing board heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,041,638; U.S. Pat. No. 3,489,194; U.S. Pat. No. 4,712,258; U.S. Pat. No. 4,886,150; U.S. Pat. No. Des. 279,428; and U.S. Pat. No. Des. 376,689.

While these devices fulfill their respective, particular objectives and requirements, the aforementioned patents do not disclose a new portable diaper changing board. The inventive device includes four support members two of which are end members and two of which are intermediate member which are hingedly attached end-to-end to one another and to the end members with each of the support members having a concave to side and a flat bottom side; and also includes a plurality of fastening members for securing the support members in a folded position; and further includes a restraining member being removeably attachable to the top side of one of the intermediate members for restraining a child thereon; and also includes a handle member securely attached to one of the ends of one of the intermediate members.

In these respects, the portable diaper changing board according to the present invention substantially departs from the conventional concepts and designs of the prior art, and in so doing provides an apparatus primarily developed for the purpose of changing a child's diaper on a comfortable and safe surface.

SUMMARY OF THE INVENTION

In view of the foregoing disadvantages inherent in the known types of portable baby changing board now present in the prior art, the present invention provides a new portable diaper changing board construction wherein the same can be utilized for changing a child's diaper on a comfortable and safe surface.

The general purpose of the present invention, which will be described subsequently in greater detail, is to provide a new portable diaper changing board which has many of the advantages of the portable baby changing board mentioned heretofore and many novel features that result in a new portable diaper changing board which is not anticipated, rendered obvious, suggested, or even implied by any of the prior art portable baby changing board, either alone or in any combination thereof.

To attain this, the present invention generally comprises four support members two of which are end members and two of which are intermediate member which are hingedly attached end-to-end to one another and to the end members with each of the support members having a concave to side and a flat bottom side; and also includes a plurality of fastening members for securing the support members in a folded position; and further includes a restraining member being removeably attachable to the top side of one of the intermediate members for restraining a child thereon; and also includes a handle member securely attached to one of the ends of one of the intermediate members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable diaper changing board which has many of the advantages of the portable baby changing board mentioned heretofore and many novel features that result in a new portable diaper changing board which is not anticipated, rendered obvious, suggested, or even implied by any of the prior art portable baby changing board, either alone or in any combination thereof.

It is another object of the present invention to provide a new portable diaper changing board which may be easily and efficiently manufactured and marketed.

It is a further object of the present invention to provide a new portable diaper changing board which is of a durable and reliable construction.

An even further object of the present invention is to provide a new portable diaper changing board which is susceptible of a low cost of manufacture with regard to both materials and labor, and which accordingly is then susceptible of low prices of sale to the consuming public, thereby making such portable diaper changing board economically available to the buying public.

Still yet another object of the present invention is to provide a new portable diaper changing board which provides in the apparatuses and methods of the prior art some of the advantages thereof, while simultaneously overcoming some of the disadvantages normally associated therewith.

Still another object of the present invention is to provide a new portable diaper changing board for changing a child's diaper on a comfortable and safe surface.

Yet another object of the present invention is to provide a new portable diaper changing board which includes four support members two of which are end members and two of which are intermediate member which are hingedly attached end-to-end to one another and to the end members with each of the support members having a concave to side and a flat bottom side; and also includes a plurality of fastening members for securing the support members in a folded position; and further includes a restraining member being removeably attachable to the top side of one of the intermediate members for restraining a child thereon; and also includes a handle member securely attached to one of the ends of one of the intermediate members.

Still yet another object of the present invention is to provide a new portable diaper changing board that is easy to carry and take along and gives the parent a device upon which to change the child's diaper.

Even still another object of the present invention is to provide a new portable diaper changing board that is lightweight and can be taken anywhere.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
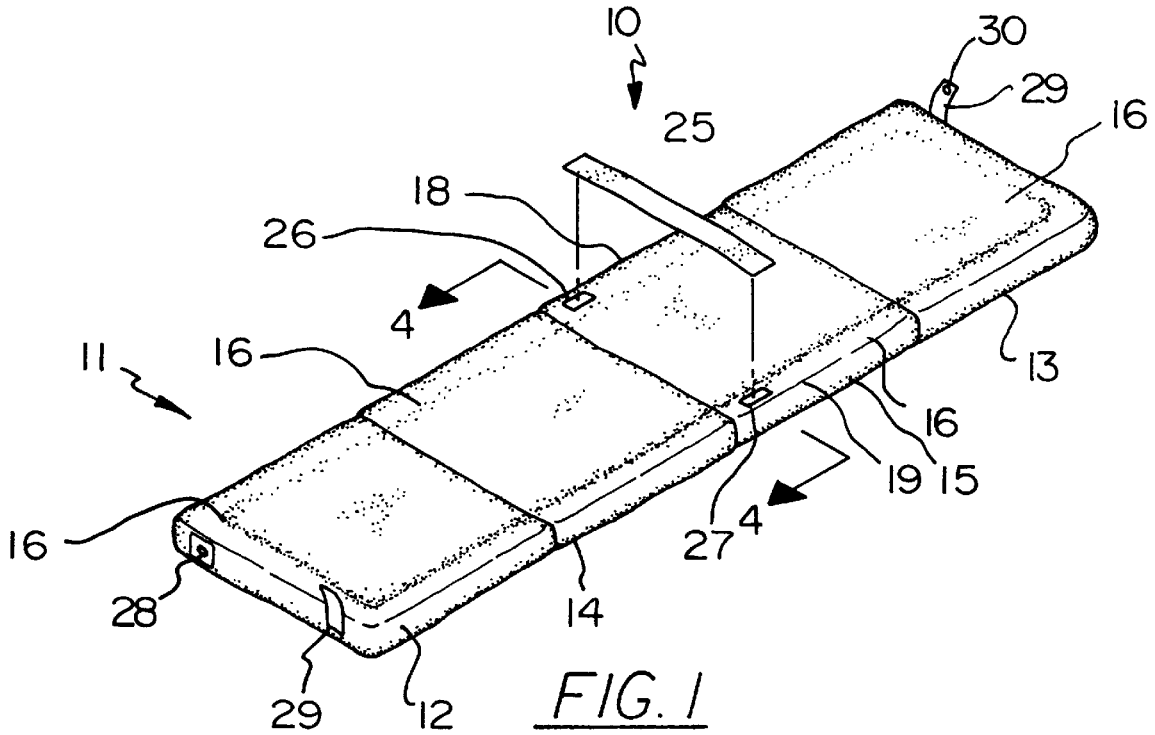
FIG. 1 is a top perspective view of a new portable diaper changing board according to the present invention.
Figure 2:
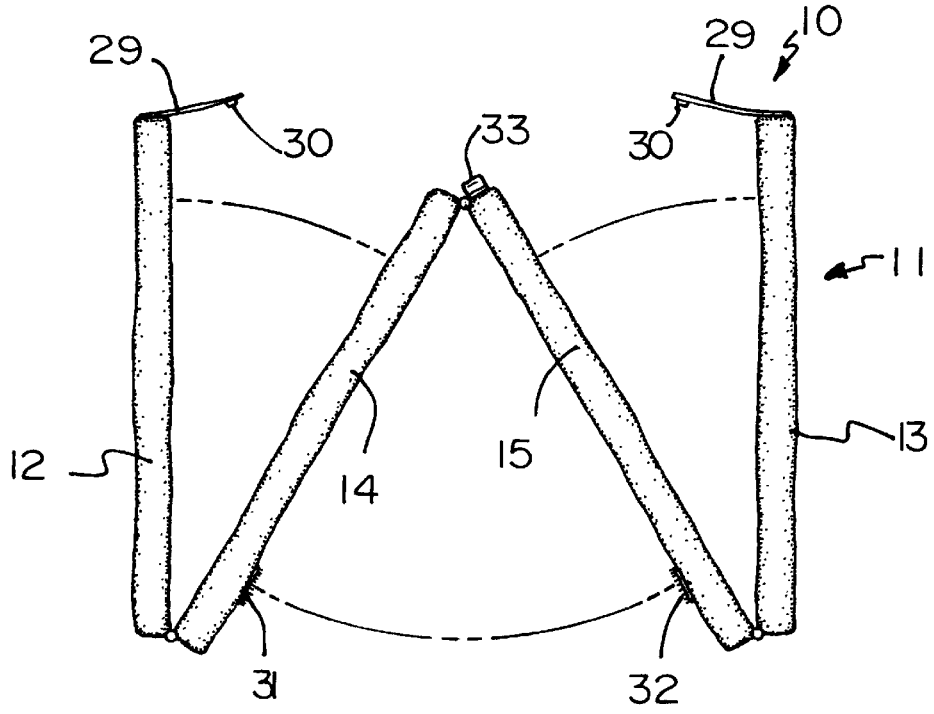
FIG. 2 is a side elevational view of the present invention.
Figure 3:
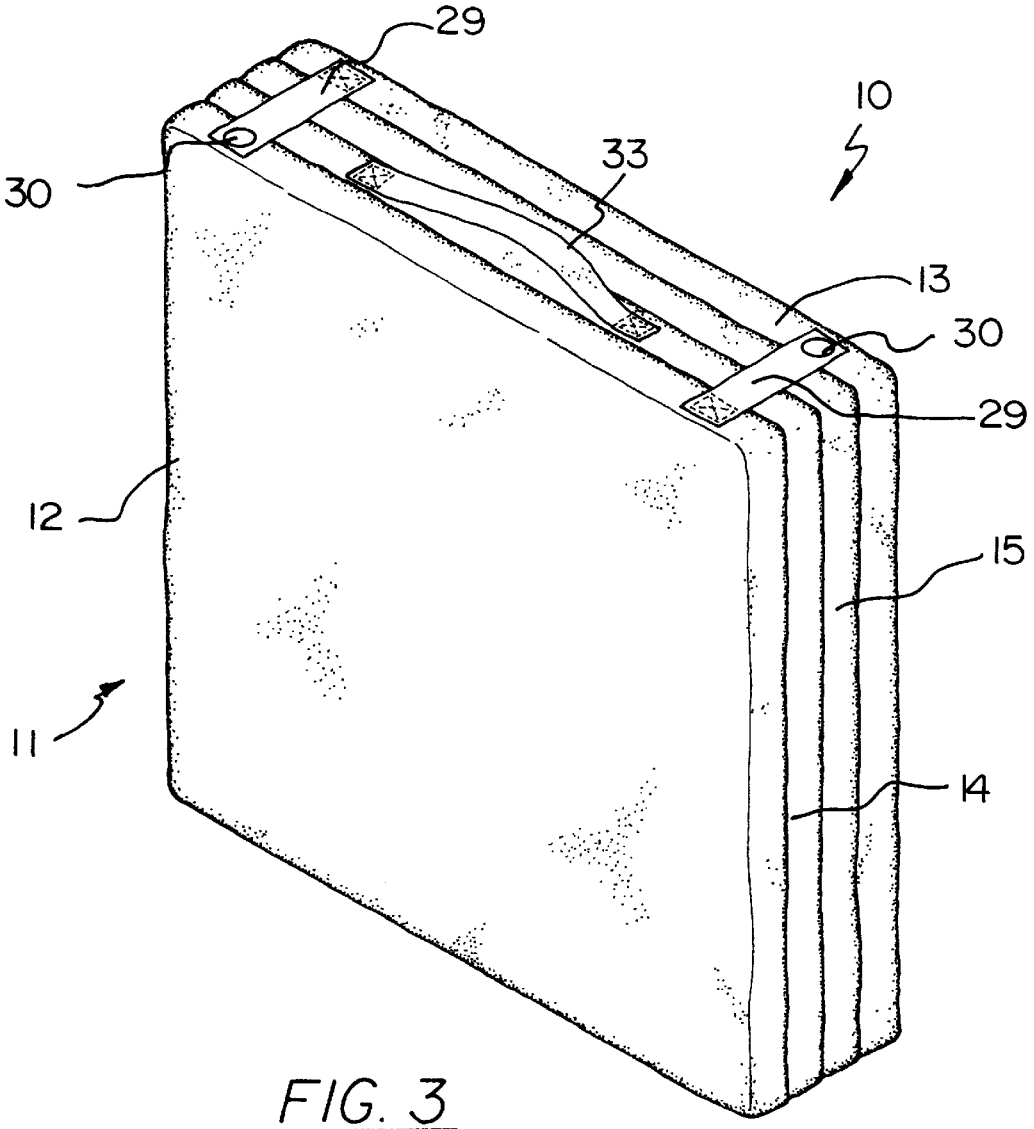
FIG. 3 is a perspective view of the present invention in a folded position.
Figure 4:
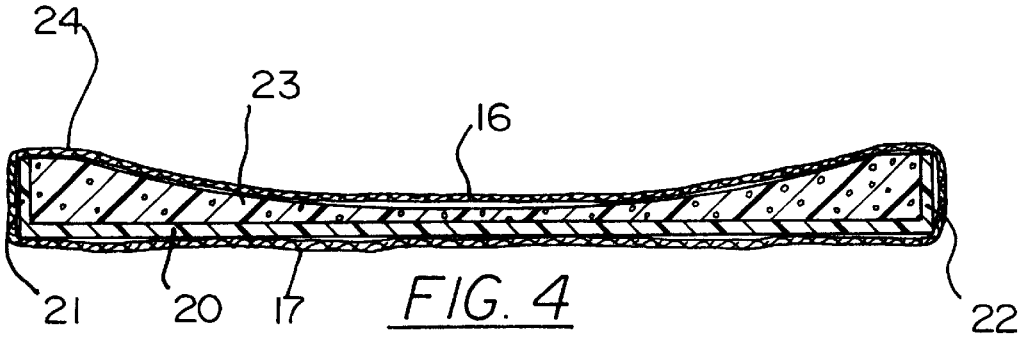
FIG. 4 is a side cross-sectional view of one of the support members of the present invention.

With reference now to the drawings, and in particular to FIGS. 1 through 4 thereof, a new portable diaper changing board embodying the principles and concepts of the present invention and generally designated by the reference numeral 10 will be described.

As best illustrated in FIGS. 1 through 4, the portable diaper changing board 10 generally comprises a plurality of support members 11 including a pair of end members 12,13 and a plurality of intermediate members 14,15 a first one 14 of which is hingedly and conventionally attached to one of the end members 12 and a second one 15 of which is hingedly and conventionally attached to the other of the end members 13. The intermediate members 14,15 are hingedly attached end-to-end with conventional hinges. Each of the support members 11 further has a top side 17 and a bottom side 17 and opposed side edges 18,19 with the support members 11 being foldable upon one another and being adapted to lie end-to-end in a generally horizontal position to support a child thereon. The top side 16 of each of the support members 11 is essentially concave, and the bottom side 17 of each of the support members 11 is essentially flat. Each of the support members 11 includes a base member 20, a padded member 23 disposed upon the base member 20, and a piece of material 24 securely enclosed about the base member 20 and the padded member 23. The base member 20 includes a planar member and upstanding side walls 21,22 integrally attached at side ends of the planar member. Each of the support members 11 has a thickness of approximately ½ inches and has a width of approximately 1½ feet and has a length of approximately 1 foot. A restraining member is removeably attached to the top side 16 of one of the support members 11 for restraining a child to the support members 11. The restraining member includes a strap member 25 and hook and loop fasteners 26,27 securely attached or sewn to a top side 16 of one of the intermediate members 15. The strap member 25 is removeably attached to the hook and loop fasteners 26,27 with each of the hook and loop fasteners 26,27 being securely attached near a respective one of the side edges 18,19 of the intermediate member 15. A plurality of fastening members 28,29,31,32 are securely and conventionally attached to the support members 11 for securing the support members 11 in a folded position. The plurality of fastening members includes snap-on members 28,29,30 and hook and loop fastening members 31,32 with the snap-on members 28,29,30 being securely and conventionally attached to ends of the end members 12,13 of the support members 11 and with the hook and loop fastening members 31,32 being securely and conventionally attached to the bottom sides 17 of two of the intermediate members 14,15 of the support members 11. Each of the snap-on members includes a first snap member 28 securely attached or sewn to the end of one of the end members 12,13 and further includes a strap member 29 having an end securely attached or sewn to the end of the other of the end members 12,13 and a second snap member 30 being securely and conventionally attached to the strap member 29 and being adapted to fasten to the first snap member 28 when the support members 11 are folded upon one another. The hook and loop fastening members 31 on one of the two intermediate members 14 are adapted to fasten to the hook and loop fastening members 32 on the other of the two intermediate members 15 when the support members 11 are folded upon one another. A handle member 33 is securely and conventionally attached to an end of one of the support members 11 for carrying the support members 11 in a folded position. The handle member 33 is a flexible handle member and is securely attached to an end of one of the intermediate members 15 of the support members 11.

In use, the user unfolds the support members 11 upon generally horizontal surface by first unfastening the fastening members 28,29,30. The user then lays the child upon the top side 16 of the support members 11 and places the strap member 25 over the child and fastens the strap member 25 to the hook and loop fasteners 18,19 to secure the child to the diaper changing device 10. Once finished, the user can easily and simply fold the support members 11 and fasten them together with the fastening members 28,29,30.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable diaper changing device comprising:

a plurality of support members including a pair of end members and a plurality of intermediate members a first one of which is hingedly attached to one of said end members and a second one of which is hingedly attached to the other of said end members, said intermediate members being hingedly attached end-to-end, each of said support members further having a top side and a bottom side and opposed side edges, said support members being foldable upon one another and being adapted to lie end-to-end in a generally horizontal position to support a child thereon;

a restraining member being removeably attached to said top side of one of said support member for restraining a child to said support members;

a plurality of fastening members securely attached to said support members for securing said support members in a folded position;

a handle member securely attached to an end of one of said support members for carrying said support members in a folded position;

wherein said restraining member includes a strap member and hook and loop fasteners securely attached to a top side of one of said intermediate members, said strap member being removeably attached to said hook and loop fasteners;

wherein each of said hook and loop fasteners is securely attached near a respective one of said side edges of said intermediate member;

wherein said handle member is a flexible handle member and is securely attached to an end of one of said intermediate members of said support members;

wherein said plurality of fastening members include snap-on members and hook and loop fastening members, said snap-on members being securely attached to ends of said end members of said support members, said hook and loop fastening members being securely attached to said bottom sides of two of said intermediate members of said support members;

wherein each of said snap-on members includes a first snap member securely attached to said end of one of said end members and further includes a strap member having an end securely attached to said end of the other of said end members and a second snap member securely attached to said strap member and being adapted to fasten to said first snap member when said support members are folded upon one another;

wherein said hook and loop fastening members on one of said two intermediate members are adapted to fasten to said hook and loop fastening members on the other of said two intermediate members when said support members are folded upon one another;

wherein said top side of each of said support members is essentially concave and said bottom side of each of said support members is essentially flat; and wherein each of said support members includes a base member, a padded member disposed upon said base member, and a piece of material securely enclosed about said base member and said padded member.

2. A portable diaper changing device as described in claim 1, wherein said base member includes a planar member and upstanding side walls integrally attached at side ends of said planar member.

3. A portable diaper changing device as described in claim 1, wherein each of said support members has a thickness of approximately ½ inches and has a width of approximately 1½ feet and has a length of approximately 1 foot.

4. A portable diaper changing device comprising:

a plurality of support members including a pair of end members and a plurality of intermediate members a first one of which is hingedly attached to one of said end members and a second one of which is hingedly attached to the other of said end members, said intermediate members being hingedly attached end-to-end, each of said support members further having a top side and a bottom side and opposed side edges, said support members being foldable upon one another and being adapted to lie end-to-end in a generally horizontal position to support a child thereon, said top side of each of said support members being essentially concave and said bottom side of each of said support members is essentially flat, each of said support members including a base member, a padded member disposed upon said base member, and a piece of material securely enclosed about said base member and said padded member, said base member including a planar member and upstanding side walls integrally attached at side ends of said planar member, each of said support members having a thickness of approximately ½ inches and having a width of approximately 1½ feet and having a length of approximately 1 foot;

a restraining member being removeably attached to said top side of one of said support member for restraining a child to said support members, said restraining member including a strap member and hook and loop fasteners securely attached to a top side of one of said intermediate members, said strap member being removeably attached to said hook and loop fasteners, each of said hook and loop fasteners being securely attached near a respective one of said side edges of said intermediate member;

a plurality of fastening members securely attached to said support members for securing said support members in a folded position, said plurality of fastening members including snap-on members and hook and loop fastening members, said snap-on members being securely attached to ends of said end members of said support members, said hook and loop fastening members being securely attached to said bottom sides of two of said intermediate members of said support members, each of said snap-on members including a first snap member securely attached to said end of one of said end members and further including a strap member having an end securely attached to said end of the other of said end members and a second snap member being securely attached to said strap member and being adapted to fasten to said first snap member when said support members are folded upon one another, said hook and loop fastening members on one of said two intermediate members being adapted to fasten to said hook and loop fastening members on the other of said two intermediate members when said support members are folded upon one another; and a handle member securely attached to an end of one of said support members for carrying said support members in a folded position, said handle member being a flexible handle member and being securely attached to an end of one of said intermediate members of said support members.

5. A portable diaper changing device comprising:

a plurality of support members including a pair of end members and a plurality of intermediate members a first one of which is hingedly attached to one of said end members and a second one of which is hingedly attached to the other of said end members, said intermediate members being hingedly attached end-to-end, each of said support members further having a top side and a bottom side and opposed side edges, said support members being foldable upon one another and being adapted to lie end-to-end in a generally horizontal position to support a child thereon;

a restraining member being removeably attached to said top side of one of said support member for restraining a child to said support members;

a plurality of fastening members securely attached to said support members for securing said support members in a folded position;

a handle member securely attached to an end of one of said support members for carrying said support members in a folded position; and wherein each of said support members includes a base member, a padded member disposed upon said base member, and a piece of material securely enclosed about said base member and said padded member.

6. A portable diaper changing device as described in claim 5, wherein said restraining member includes a strap member and hook and loop fasteners securely attached to a top side of one of said intermediate members, said strap member being removeably attached to said hook and loop fasteners.

7. A portable diaper changing device as described in claim 5, wherein each of said hook and loop fasteners is securely attached near a respective one of said side edges of said intermediate member.

8. A portable diaper changing device as described in claim 5, wherein said handle member is a flexible handle member and is securely attached to an end of one of said intermediate members of said support members.

9. A portable diaper changing device as described in claim 5, wherein said plurality of fastening members include snap-on members and hook and loop fastening members, said snap-on members being securely attached to ends of said end members of said support members, said hook and loop fastening members being securely attached to said bottom sides of two of said intermediate members of said support members.

10. A portable diaper changing device as described in claim 9, wherein each of said snap-on members includes a first snap member securely attached to said end of one of said end members and further includes a strap member having an end securely attached to said end of the other of said end members and a second snap member securely attached to said strap member and being adapted to fasten to said first snap member when said support members are folded upon one another.

11. A portable diaper changing device as described in claim 10, wherein said hook and loop fastening members on one of said two intermediate members are adapted to fasten to said hook and loop fastening members on the other of said two intermediate members when said support members are folded upon one another.

12. A portable diaper changing device as described in claim 5, wherein said top side of each of said support members is essentially concave and said bottom side of each of said support members is essentially flat.

13. A portable diaper changing device as described in claim 5, wherein said base member includes a planar member and upstanding side walls integrally attached at side ends of said planar member.

14. A portable diaper changing device as described in claim 5, wherein each of said support members has a thickness of approximately ½ inches and has a width of approximately 1½ feet and has a length of approximately 1 foot.

* * * * *